United States Patent [19]

Kuhn

[11] 4,363,298

[45] Dec. 14, 1982

[54] LAWN MOWER BRAKE AND STARTER

[75] Inventor: John B. Kuhn, Beaver Dam, Wis.

[73] Assignee: Outboard Marine Corporation, Waukegan, Ill.

[21] Appl. No.: 217,586

[22] Filed: Dec. 18, 1980

[51] Int. Cl.[3] ..... F02N 5/02

[52] U.S. Cl. ..... 123/179 S; 123/179 SE; 123/185 F; 123/198 DC; 123/179 BG; 185/39; 74/6

[58] Field of Search ..... 74/6; 185/41 A, 39; 123/179 S, 179 SE, 179 T, 185 F, 198 DC, 179 BG

[56] References Cited

U.S. PATENT DOCUMENTS

| | | | |
|---|---|---|---|
| 993,956 | 5/1911 | Burns | 185/41 A |
| 1,031,134 | 7/1912 | Markmann et al. | 123/179 S |
| 3,149,621 | 9/1964 | Bailey | 123/179 S |
| 3,301,243 | 1/1967 | Lyvers | 123/179 S |
| 3,861,374 | 1/1975 | Dooley et al. | 123/179 S |

*Primary Examiner*—Charles J. Myhre
*Assistant Examiner*—Andrew M. Dolinar
*Attorney, Agent, or Firm*—Michael, Best & Friedrich

[57] ABSTRACT

Disclosed herein is a lawn mower including an engine having a first rotatable gear, an energy storage and delivery mechanism connected to said engine and comprising an energy storing spiral spring, a gear set including rotatably mounted second and third gears in mesh with each other and with one of the gears of the gear set connected to the spiral spring, which gear set is displaceable between a stop position wherein one of the second and third gears is in mesh with the first gear so as, in response to rotation of the first gear, to rotate the second and third gears in the direction which is effective to store energy in the spiral spring and a start position wherein the other of said second and third gears is in mesh with the first gear so as, in response to delivery of energy to the gear set from the spiral spring, to rotate the first gear in the engine operating direction, a releasable pawl movable selectively between positions engaged with and disengaged from the energy storage and delivery mechanism for permitting delivery of energy to the spiral spring and preventing delivery of energy from the spiral spring when in the engaged position and for permitting delivery of energy from the spiral spring when in disengaged position, and mechanism for selectively displacing the releasable means from the engaged position in response to movement of the gear set to the start position and to the engaged position in response to gear set movement from the start position.

16 Claims, 8 Drawing Figures

Fig. 6
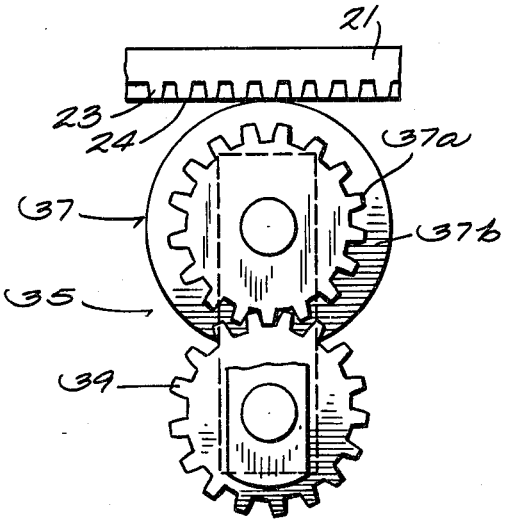
Fig. 7
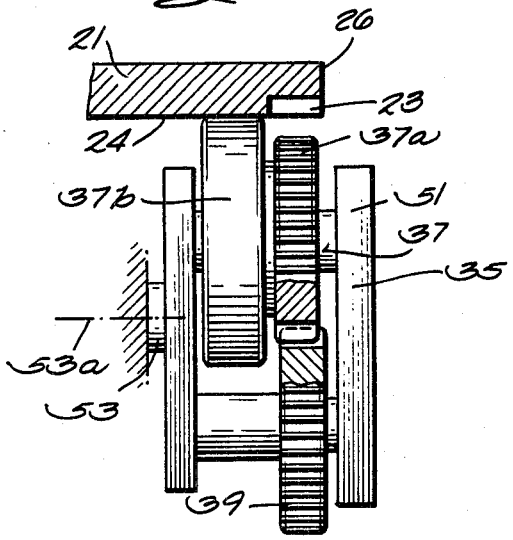
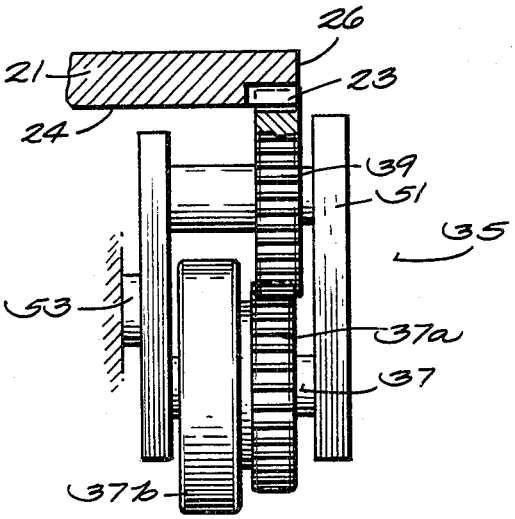
Fig. 8

LAWN MOWER BRAKE AND STARTER

BACKGROUND OF THE INVENTION

The invention relates generally to arrangements for starting and braking rotation of internal combustion engines. More particularly, the invention relates to lawn mowers and to arrangements for starting and braking the engine thereof.

Attention is directed the Markmann et al. U.S. Pat. No. 1,031,134 issued July 2, 1912 and to the Lyvers U.S. Pat. No. 3,301,243 issued Jan. 31, 1967.

SUMMARY OF THE INVENTION

The invention provides a lawn mower including an engine having a first rotatable member, an energy storage and delivery mechanism connected to the engine and comprising energy storage means, an assembly including rotatably mounted second and third members in driving engagement with each other and with one of the members of the assembly being connected to the energy storage means, the assembly being displaceable between a stop position wherein one of the second and third members is in mesh with the first member so as, in response to rotation of the first member, to rotate the second and third members in the direction which is effective to store energy in the storage means, and a start position wherein the other of the second and third members is in mesh with the first member so as, in response to delivery of energy to the assembly from the storage means, to rotate the first member in the engine operating direction, releasable means movable selectively between positions engaged with and disengaged from the energy storage and delivery mechanism for permitting delivery of energy to the storage means and preventing delivery of energy from the storage means when in the engaged position and for permitting delivery of energy from the storage means when in disengaged position, and means for selectively displacing the releasable means from the engaged position in response to movement of the assembly to the start position and to the engaged position in response to assembly movement from the start position.

In accordance with one embodiment of the invention, the engine includes an ignition system which is selectively conditionable between operative and inoperative conditions and the lawn mower further includes means for selectively conditioning the ignition system in the operative condition in response to movement of the assembly to the start position, and in the inoperative condition in response to movement of the assembly from the start position.

In accordance with one embodiment of the invention, the lawn mower also includes means selectively operable for displacing the assembly to the start position, whereby simultaneously to displace the releasable means to the disengaged position so as to permit delivery of energy from the energy storage means to the first member and for displacing the assembly in the opposite direction from the start position, whereby simultaneously to permit movement of the releasable means to the engaged position so as to permit delivery of energy to the storage means and prevent delivery of energy from the storage means.

In accordance with one embodiment of the invention, the lawn mower further includes means biasing the releasable means toward the engaged position.

In accordance with one embodiment of the invention, the lawn mower further includes stop means fixed relative to the engine and engageable selectively with the assembly to locate the assembly in the stop and start positions.

In one embodiment of the invention, the engine includes a flywheel having thereon a first gear constituting the first member.

In one embodiment of the invention, the assembly is displaceable to a running position located intermediate the start and stop positions and with the assembly out of engagement with the first gear.

In one embodiment of the invention, the second and third members have respective axis and the energy storage and delivery mechanism also includes a lever which rotatably supports the second and third members and which is pivotable about an axis fixed with respect to the engine and parallel to and between the axis of the second and third members so as to selectively locate the assembly in the start and stop positions.

In one embodiment of the invention, the lever has opposite ends and further includes stop means fixed relative to the engine for selective engagement with the opposed ends of the lever so as to selectively locate the assembly in the start and stop positions.

In one embodiment of the invention, the releaseable means comprises a pawl pivotally mounted on the lever, means biasing the pawl to the engaged position, and means fixed with respect to the engine and engageable with the pawl for displacing the pawl against the action of the biasing means away from the engaged position in response to assembly movement to the start position.

In one embodiment of the invention, the ignition system includes an ignition switch which is fixed relative to the engine and which includes a contact movable between a first position enabling engine operation and a second position disenabling engine operation, and biased to the disenabling position, and means on the lever engageable with the contact for displacing the contact to the enabling position in response to assembly movement to the start position.

In one embodiment in accordance with the invention, the assembly comprises a gear set including second and third gears in meshing engagement with each other.

In one embodiment in accordance with the invention, the first rotatable member comprises a flywheel including a first gear and the assembly comprises a gear set including second and third gears in meshing engagement with each other and located for selective engagement with the flywheel gear.

In one embodiment in accordance with the invention, the first rotatable member is a compound member including a gear which is engageable with the first rotatable member when the assembly is in the start position, and a friction wheel which has a diameter greater than the gear and which is engageable with the first rotatable member when the assembly is in the stop position.

Other features and advantages of the embodiments of the invention will become known by reference to the following general description, claims and appended drawings

IN THE DRAWINGS

FIG. 6 is a fragmentary elevational view, with parts omitted, of a second embodiment of the invention.

FIG. 7 is a cross-sectional view of the second embodiment with the components shown arranged for energy storing operation.

FIG. 8 is a view similar to FIG. 7 with the components shown arranged for starting operation.

Figure 1:
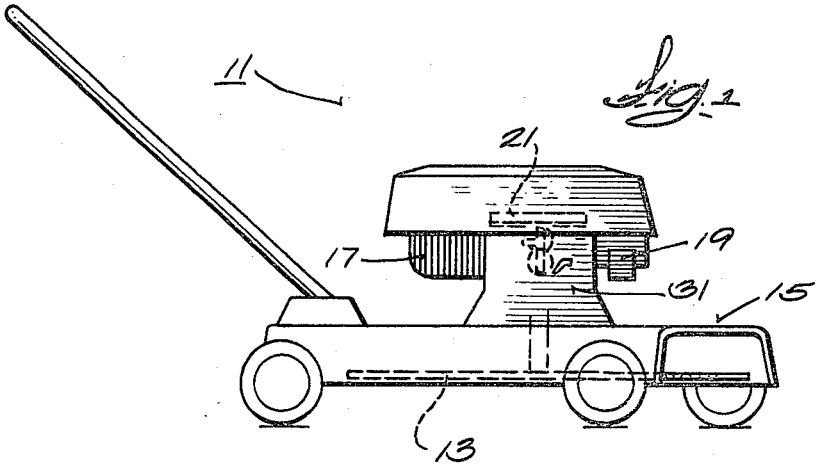
FIG. 1 is a side elevational view of a lawn mower incorporating various of the features of the invention.

Before explaining one embodiment of the invention in detail, it is to be understood that the invention is not limited in its application to the details of construction and the arrangement of components set forth in the following desription or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Figure 3:
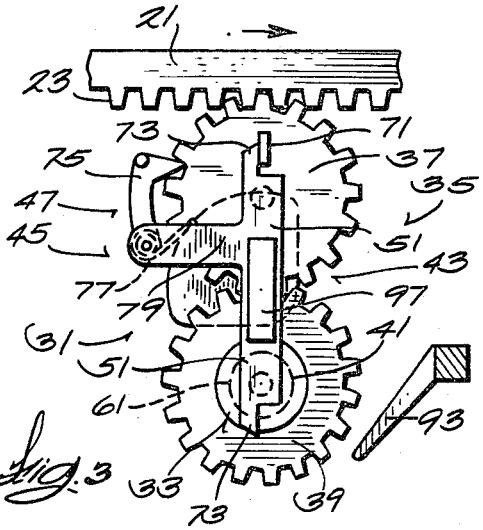
FIG. 3 is a fragmentary elevational view taken along line 3—3 of FIG. 2 and showing the components in one position.
Figure 2:
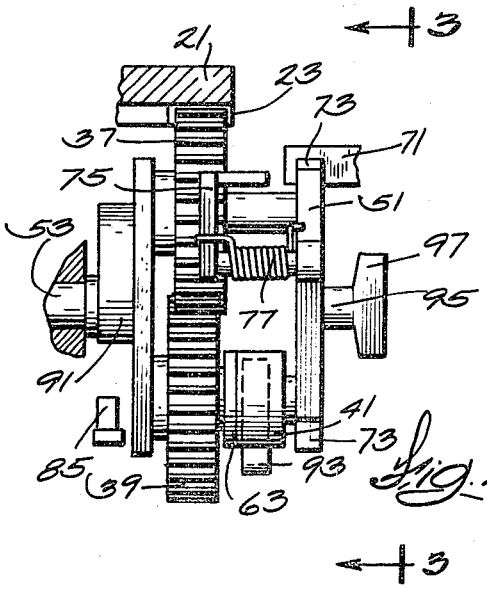
FIG. 2 is a partially sectional, fragmentary elevational view of a part of the lawn mower shown in FIG. 1.

Shown in the drawings is a lawn mower 11 including a cutter blade 13 which is rotatable in a blade housing 15 by an internal combustion engine 17 mounted on the blade housing 15. The internal combustion engine 17 includes a suitable ignition system 19 (shown schematically) which can be selectively conditioned either in an ignition-enabling, operative, or on condition and in an ignition-disabling, inoperative, or off condition. In addition, the engine 17 includes a rotatable member which, in the disclosed construction, comprises a flywheel 21 preferably including a first or starting gear 23 (See FIGS. 2 and 3). While the first rotatable member or starting gear 23 is preferably a part of the flywheel 21, other rotatable members can be employed, and the first rotatable member or starting gear 23 could be connected to the engine crankshaft by other means.

Figure 5:
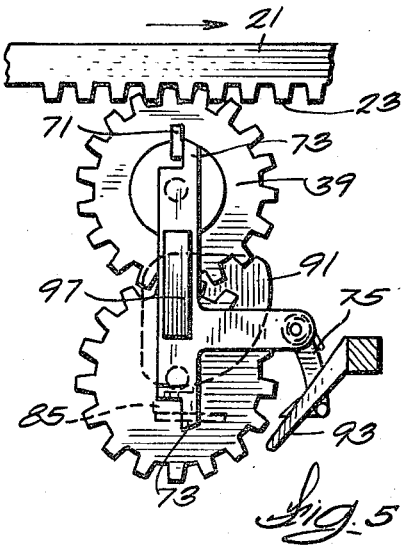
FIG. 5 is a view similar to FIG. 3 showing the components in still another position.

Also included in the lawn mower 11 is means 31 selectively operable to start and stop the engine. While various constructions can be employed, in the illustrated construction, such means 31 for selectively starting and stopping the engine comprises an energy storage and delivery mechanism 33 including an assembly 35 comprising second and third rotatable members 37 and 39, respectively, in driving engagement with each other, together with energy storage means 41 connected to one of the members 37 and 39, and means 43 for selectively engaging the assembly 35 with the flywheel gear 23 in a first or start condition or position (See FIG. 5) wherein rotary energy is delivered to the flywheel 21 from the energy storage means 41, and in a second or stop condition or position (see FIG. 3) wherein rotary energy is removed from the flywheel 21 and delivered to the energy storage means 41. While other rotatable members could be employed, such as friction wheels, in the illustrated construction, the rotatable members 37 and 39 comprise second and third gears in meshing engagements.

In addition, the means 31 for selectively starting and stopping the engine 17 includes means 45 for selectively conditioning the ignition system 19 in the operative or on condition when the gear set 35 is in the second or start condition and in the inoperative or off condition when the gear set 35 is displaced from the second or start condition. Still further, the means 31 for selectively starting and stopping the engine includes releasable means 47 for permitting delivery of energy to the energy storage means 41 from the flywheel 21 and for preventing delivery of energy from the energy storage means 41 when the gear set 35 is displaced from the start condition or position and for permitting delivery of energy from the storage means 41 to the flywheel 21 when the gear set 35 is in the start condition.

Figure 4:
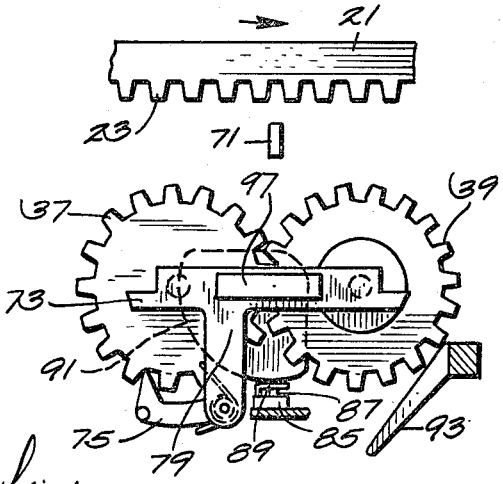
FIG. 4 is a view similar to FIG. 3 showing the components in another position.

While other constructions could be employed, in the illustrated construction, the first and second gears 37 and 39 are rotatably mounted in axially spaced relation on a lever 51 which, in turn, is mounted for pivotal movement about a pivot 53 located between the axis of the gears 37 and 39 and fixed with respect to the engine 17. The lever 51 is movable between a first or start position (See FIG. 5) in which the gear set 35 is in the start condition with the gear 39 in engagement with the flywheel gear 21, a second or stop position (See FIG. 3) which is displaced approximately 180° from the start position and in which the gear set 35 is in the stop position with the gear 37 in mesh with the flywheel gear 21, and a third or intermediate or neutral or running position (See FIG. 4) in which both gears 37 and 39 are out of engagement with the flywheel gear 23.

Any suitable energy storage means 41 can be employed. In the disclosed construction, such energy storage means 41 comprises a spiral or clock spring 61 which is mounted co-axially with one of the gears 37 and 39 so as to receive energy in response to rotation of the connected gear in one direction and so as to deliver energy to the connected gear so as to rotate the connected gear in the other direction. The spiral or clock spring 61 can be associated with either of the gears 37 and 39 and in the disclosed construction, is carried co-axially with the gear 39.

Preferably, a suitable combination brake and overload clutch 63 is interposed between the gear 39 and the spiral spring 61.

Stop means fixed relative to the engine 17 are preferably provided for selective engagement with the lever 51 to selectively locate the lever 51 in the start and stop positions. While various arrangements can be employed, in the illustrated construction, such means comprises a stop or abutment 71 fixed relative to the engine 17 in position for selective engagement with respective ears 73 extending from the opposite ends of the lever 51 so as to limit pivotal movement of the lever 51 in opposite directions through approximately 180° and thereby to facilitate selective engagement of the gears 37 and 39 with the flywheel 21.

Various means can be employed for permitting delivery of energy to the storage means 41 from the flywheel 21 and for selectively permitting and preventing delivery of energy from the spiral spring 61 to the flywheel 21. In the disclosed construction, there is provided a pawl 75 which is mounted on the lever 51 for movement between a first or engaged position with the gear set 35 so as to enable delivery of energy to the energy storage means 41 while preventing energy delivery from the energy storage means 41 (See FIG. 3) and a second position disengaged from the gear set 35 so as to enable energy delivery from the energy storage means 41. The pawl 75 is preferably biased by a suitable spring 77 for movement into the first position in engagement with the gear 37 so as to permit gear rotation in the direction which permits delivery of energy to the energy storage means 41 and so as to prevent gear rotation in the direction which effects delivery of energy from the energy storage means 41. While other arrangements could be employed, the pawl 75 is pivotally carried by an arm 79 extending from the lever 51.

Means are also provided for selectively conditioning the ignition system between the ignition-enabling, operative, or on position and the ignition-disabling, inoperative, or off position. While various arrangements can be employed, in the illustrated construction, such means comprises (See especially FIG. 4) a switch 85 which is fixed relative to the engine 17 and which includes a terminal 87 and a contact blade or member 89 movable into and out of engagement with the terminal 87. Suitable means (not shown) are provided for biasing the member 89 into the ignition disabling condition. In addition, a cam surface 91 is carried on the lever 51 for engagement with the member 89 for displacement thereof to the ignition enabling position when the gear set 35 is in the run and start positions.

Means are provided for displacing the pawl 75 to the non-engaged position to permit energy delivery from the storage means 41 and for closing the switch 85 in response to arrival of the lever 51 in the start position and for permitting reengagement of the pawl 75 under the influence of the spring 77 to prevent energy delivery from the storage means 41 and for opening the switch 85 in response to movement of the lever 51 in the opposite direction beyond the run or intermediate position. Such means comprises the cam surface 91 which extends from the lever 51 and engages the switch contact or member 89 to locate the switch 85 in the ignition enabling condition in response to lever movement to the start position, together with an abutment 93 which is fixed relative to the engine 17 and which engages the pawl 75 to pivotally displace the pawl 75 from the engaged position upon arrival of the lever 51 in the start position.

Means are also provided for manually displacing the lever 51 between the start and stop positions. While various arrangements can be employed, in the illustrated construction, such means comprises a shaft 95 which extends axially from the lever 51 about the axis of rotation thereof and which includes, at the outer end thereof, a handle 97 which can be manipulated by an operator to selectively displace the lever 51 between the start and stop positions.

In operation, and assuming the prior storage of energy in the spiral spring 61, displacement of the lever 51 to the start position (See FIG. 5) engages the gear 39 with the flywheel gear 21, conditioning the ignition system 19 in the operative or on position by displacing the member 89 to the ignition enabling position, and displacing the pawl 75 away from the engaged position, whereby permitting delivery of energy from the spiral spring 61 through the gear set 35 so as to rotate the flywheel 21 in the running direction and thereby to enable engine starting.

Upon initiation of engine starting, the flywheel 21 rotates at a speed which is sufficient to cause rotation of the lever 51 away from the start position and to the neutral or running position with the gear set 35 out of engagement with the flywheel gear 23. Such movement away from the start position permits resetting of the pawl 75 by the spring 77 in the engaged position but permits continuation of the conditioning of the ignition system 19 in the operative or on position.

When it is desired to stop the engine 17, the lever 51 is manually displaced to the stop position, thereby causing conditioning of the ignition system 19 in the inoperative or off position by permitting movement of the member 89 under its bias to the ignition disabling position, and thereby also causing engagement of the gear 37 with the flywheel gear 23 so as to rotate the gear set 35 in the direction which is effective to store energy in the spiral spring 65. Because the pawl 75 has previously been biased to the engaged position, delivery of energy to the spiral spring 61 is permitted but energy delivery from the spiral spring 61 is prevented.

Energy transfer to the spiral spring 61 serves to remove energy from the flywheel 21 and therefore serves to quickly brake or stop engine rotation, as well as to store energy in the spiral spring 61 for use during a subsequent engine starting operation, as above described.

Shown in FIGS. 6, 7 and 8 is a second embodiment wherein the reference numerals which have been applied to the first embodiment shown in FIGS. 1 through 5 are again applied to similar components and in which certain parts shown in FIGS. 1 through 5 are shown schematically or are omitted, it being understood that the second embodiment, except as otherwise described, includes all the features of this first embodiment. In the second embodiment, the rotatable member is in the form of a flywheel 21 having, on the undersurface thereof, a ring or first gear 23 and an inner annular surface portion 24. In addition, rotatable member 37 is a compound member including a gear **37*a* which is in meshing engagement with the gear 39 and a friction wheel 37*b* which is bonded to or forms an integral part of the gear 37*a*, which has an outer diameter greater than the outer diameter of the gear 37*a*, and which is located for driving engagement with the undersurface portion 24 of the flywheel 21 when the assembly is in the stop position, as shown in FIG. 7**.

In the embodiment shown in FIGS. 6, 7 and 8 the assembly 35 is mounted for pivotal movement about a pivot or axis **53(*a*) between the stop position (FIG. 7) and the start position (FIG. 8) such that as already indicated, when in the stop position, the friction wheel 37*b* is engaged with the flywheel surface portion 24 and the second gear 37*a* is clear of the flywheel 21, and such that, when the assembly 35 is in the start position, the gear 39 is in mesh with the flywheel gear 23. This construction avoids possible damage to the gear 37 from attempted engagement thereof with the rapidly rotating flywheel gear 24 in response to movement of the assembly 35 to the stop position. When the assembly 35 is moved to the start position, the flywheel 21 is not rotating and, accordingly, effecting meshing engagement between the gears 23 and 39** can be readily accomplished.

As desired, the friction wheel **37(*b*) could be designed to engage the outer edge 26 of the flywheel 21**.

In other respects all of the other features described in the embodiment of FIGS. 1 through 5 can also be employed in the embodiment of FIGS. 6, 7 and 8.

Various of the features of the invention are set forth in the following claims.

I claim:

1. A lawn mower including an engine having a first rotatable member, an energy storage and delivery mechanism connected to said engine and comprising energy storage means, an assembly including rotatably mounted second and third members in direct driving engagement with each other and with one of said members of said assembly being connected to said energy storage means, said assembly being displaceable between a stop position wherein one of said second and third members is in direct driving engagement with said first member so as, in response to rotation of said first member, to rotate said second and third members in the direction which is effective to store energy in said storage means and a start position wherein the other of said second and third members in in direct driving engagement with said first member so as, in response to delivery of energy to said assembly from said storage means, to rotate said first member in the engine operating direction, releasable means movable selectively between positions engaged with and disengaged from said energy storage and delivery mechanism for permitting delivery of energy to said storage means and preventing delivery of energy from said storage means when in the engaged position and for permitting delivery of energy from said storage means when in disengaged position, and means for selectively displacing said releasable means from said engaged position in response to movement of said assembly to said start position and to said engaged position in response to assembly movement from said start position.

2. A lawn mower including an engine having an ignition system which is selectively conditionable between operative and inoperative conditions, a first rotatable member, an energy storage and delivery mechanism connected to said engine and comprising energy storage means, an assembly including rotatably mounted second and third members in driving engagement with each other and with one of said members of said assembly being connected to said energy storage means, said assembly being displaceable between a stop position wherein one of said second and third members is in driving engagement with said first member so as, in response to rotation of said first member, to rotate said second and third members in the direction which is effective to store energy in said storage means and a start position wherein the other of said second and third members is in driving engagement with said first member so as, in response to delivery of energy to said assembly from said storage means, to rotate said first member in the engine operating direction, releasable means movable selectively between positions engaged with and disengaged from said energy storage and delivery mechanism for permitting delivery of energy to said storage means and preventing delivery of energy from said storage means when in the engaged position and for permitting delivery of energy from said storage means when in disengaged position, means for selectively displacing said releasable means from said engaged position in response to movement of said assembly to said start position and to said engaged position in response to assembly movement from said start position, and means for selectively conditioning said ignition system in said operative condition in response to movement of said assembly to said start position, and in said inoperative condition in response to movement of said assembly from said start position.

3. A lawn mower in accordance with claim 1 and further including means selectively operable for displacing said assembly to said start position, whereby simultaneously to displace said releasable means to said disengaged position so as to permit delivery of energy from said energy storage means to said first member and for displacing said assembly in the opposite direction from said start position, whereby simultaneously to permit movement of said releasable means to said engaged position so as to permit delivery of energy to said storage means and prevent delivery of energy from said storage means.

4. A lawn mower in accordance with claim 1 and further including means biasing said releasable means toward said engaged position.

5. A lawn mower in accordance with claim 1 and further including stop means fixed relative to said engine and engageable selectively with said assembly to locate said assembly in said stop and start positions.

6. A lawn mower in accordance with claim 1 wherein said engine includes a flywheel having thereon a first gear constituting said first member.

7. A lawn mower in accordance with claim 1 wherein said energy storage and delivery mechanism includes a combination brake and overload clutch interposed between said assembly and said energy storage means.

8. A lawn mower in accordance with claim 1 wherein said assembly is displaceable to a running position located intermediate said start and stop positions and with said assembly out of engagement with said first member.

9. A lawn mower including an engine having a first rotatable member, an energy storage and delivery mechanism connected to said engine and comprising energy storage means and, a lever which is pivotable about an axis fixed with respect to said engine, an assembly including second and third members mounted rotatably on said lever about respective axis located in parallel relation to and on opposite sides of said fixed axis, said second and third members being in driving engagement with each other and with one of said members of said assembly being connected to said energy storage means, said assembly being selectively displaceable about said fixed axis between a stop position wherein one of said second and third members is in driving engagement with said first member so as, in response to rotation of said first member, to rotate said second and third members in the direction which is effective to store energy in said storage means and a start position wherein the other of said second and third members is in driving engagement with said first member so as, in response to delivery of energy to said assembly from said storage means, to rotate said first member in the engine operating direction, releasable means movable selectively between positions engaged with and disengaged from said energy storage and delivery mechanism for permitting delivery of energy to said storage means and preventing delivery of energy from said storage means when in the engaged position and for permitting delivery of energy from said storage means when in disengaged position, means for selectively displacing said releasable means from said engaged position in response to movement of said assembly to said start position and to said engaged position in response to assembly movement from said start position.

10. A lawn mower in accordance with claim 9 wherein said lever has opposed ends and further including stop means fixed relative to said engine for selective engagement with said opposed ends of said lever so as to selectively locate said assembly in said start and stop positions.

11. A lawn mower in accordance with claim 9 wherein said releaseable means comprises a pawl pivotally mounted on said lever, means biasing said pawl to said engaged position, and means fixed with respect to said engine and engageable with said pawl for displacing said pawl against the action of said biasing means away from said engaged position in response to assembly movement to said start position.

12. A lawn mower in accordance with claim 9 wherein said ignition system includes an ignition switch fixed relative to said engine and including a member movable between a first position enabling engine operation and a second position disenabling engine operation, said member being biased to said disenabling position, and means on said lever engageable with said member for displacing said member to said enabling position in response to assembly movement to said start position.

13. A lawn mower in accordance with claim 1 including handle means connected to said assembly for manually displacing said assembly between said start and stop positions.

14. A lawn mower in accordance with claim 1 wherein said first rotatable member comprises a first gear and wherein said assembly comprises a gear set including second and third gears in meshing engagement with each other.

15. A lawn mower in accordance with claim 1 wherein said first rotatable member comprises a flywheel including a first gear and wherein said assembly comprises a gear set including second and third gears in meshing engagement with each other and located for selective engagement with said first gear.

16. A lawn mower including an engine having a first rotatable member, an energy storage and delivery mechanism connected to said engine and comprising energy storage means, an assembly displaceable between start and stop positions and including rotatably mounted second and third members in driving engagement with each other and with one of said members of said assembly being connected to said storage means, said second rotatable member comprising a compound member including a gear which is rotatably driven by said third member and which is in driving engagement with said first rotatable member when said assembly is in said start position, whereby said first member is rotated in the engine operating direction in response to delivery of energy to said assembly from said storage means and a friction wheel which has a diameter greater than said gear and which is engageable with said first rotatable member for rotation thereby when said assembly is in said stop position, whereby said one member is rotated in the direction which is effective to store energy in said storage means in response to rotation of said first member, releasable means movable selectively between positions engaged with and disengaged from said energy storage and delivery mechanism for permitting delivery of energy to said storage means and preventing delivery of energy from said storage means when in the engaged position and for permitting delivery of energy from said storage means when in disengaged position, and means for selectively displacing said releasable means from said engaged position in response to movement of said assembly to said start position and to said engaged position in response to assembly movement from said start position.

* * * * *